US008928641B2

(12) United States Patent
Chiu et al.

(10) Patent No.: US 8,928,641 B2
(45) Date of Patent: Jan. 6, 2015

(54) MULTIPLEX ELECTROPHORETIC DISPLAY DRIVER CIRCUIT

(75) Inventors: Wen-Pin Chiu, Taoyuan County (TW); Ping-Yueh Cheng, Taoyuan County (TW); Feng-Shou Lin, Taoyuan County (TW); Craig Lin, San Jose, CA (US); Bryan Chan, San Francisco, CA (US)

(73) Assignee: SIPIX Technology Inc., Jhongli, Taoyuan County (TW)

( * ) Notice: Subject to any disclaimer, the term of this patent is extended or adjusted under 35 U.S.C. 154(b) by 904 days.

(21) Appl. No.: 12/629,598

(22) Filed: Dec. 2, 2009

(65) Prior Publication Data

US 2011/0128266 A1 Jun. 2, 2011

(51) Int. Cl.

| | |
|---|---|
| ***G09G 5/00*** | (2006.01) |
| ***G09G 3/30*** | (2006.01) |
| ***G09G 3/34*** | (2006.01) |

(52) U.S. Cl.

CPC ..... *G09G 3/344* (2013.01); *G09G 2340/16* (2013.01)

USPC ..... 345/211; 345/76

(58) Field of Classification Search

None

See application file for complete search history.

(56) References Cited

U.S. PATENT DOCUMENTS

| | | | | |
|---|---|---|---|---|
| 2006/0011846 | A1* | 1/2006 | Ozaki | 250/363.03 |
| 2007/0229413 | A1* | 10/2007 | Hara | 345/76 |
| 2008/0211800 | A1* | 9/2008 | Arasawa et al. | 345/211 |
| 2009/0102760 | A1* | 4/2009 | Yamashita et al. | 345/76 |
| 2009/0267969 | A1* | 10/2009 | Sakamoto | 345/690 |
| 2010/0277509 | A1* | 11/2010 | Lu et al. | 345/690 |

FOREIGN PATENT DOCUMENTS

| | | |
|---|---|---|
| TW | 538263 | 6/2003 |
| TW | 200832031 | 8/2008 |

* cited by examiner

*Primary Examiner* — Joseph Haley
*Assistant Examiner* — Emily Frank
(74) *Attorney, Agent, or Firm* — Muncy, Geissler, Olds & Lowe, P.C.

(57) ABSTRACT

A multiplex electrophoretic display driver circuit comprises a memory unit, a display controller and a voltage driving unit. The memory unit has two registers respectively storing the current and former gray-level matrix signals. The gray-level matrix signal contains gray-level data corresponding to electrophoretic pixels. The display controller has an encoding circuit and a counting circuit. The encoding circuit generates a difference-value matrix signal containing difference values according to a difference between the current and former gray-level matrix signals and then generates a voltage-difference matrix signal containing voltage-difference signals corresponding to the electrophoretic pixels. The counting circuit receives the difference-value matrix signal and counts to generate refreshing values corresponding to the difference values. The encoding circuit adds the refreshing values to a next-cycled difference-value matrix signal to generate a new voltage-difference matrix signal. The voltage driving unit drives the electrophoretic pixels according to the voltage-difference matrix signal.

4 Claims, 7 Drawing Sheets

MULTIPLEX ELECTROPHORETIC DISPLAY DRIVER CIRCUIT

FIELD OF THE INVENTION

The present invention relates to a multiplex electrophoretic display driver circuit, particularly to a driver circuit, which uses a counting circuit and at least two registers to process the data series in a multiplex way and accelerate refreshing frames of an electrophoretic display.

BACKGROUND OF THE INVENTION

The electrophoretic display (also called the electronic paper or the electronic ink) is distinct from the conventional CRT (Cathode Ray Tube) or LCD (Liquid Crystal Display). In an electrophoretic display, a plurality of micro cups is arranged on a substrate, and each micro cup contains a colored dielectric solvent and charged pigment particles suspending in the colored dielectric solvent. Two electrodes are arranged outside the micro cup. When the two electrodes alter the electric potential drop in the outer rim of the micro cup, the charged pigment particles move toward the electrode charged oppositely. The movement of the charged pigment particles changes the colors presented on the electrophoretic display. For the technology of controlling the electrophoretic display, please refer to a R.O.C. patent publication No. 538263 disclosing an "Electrophoretic Display" and a R.O.C. patent publication No. 200832031 disclosing an "Electronic Paper Device and Method for Fabricating the Same". The theories and architectures disclosed in the prior arts for controlling an electrophoretic display are essentially similar and all utilize the potential difference to alter the colors presented on the display. The prior arts had fully demonstrated the difference between the electrophoretic display and CRT/LCD. Therefore, it will not repeat herein.

Refer to FIG. 1 for a conventional driver circuit of an electrophoretic display. The conventional driver circuit comprises a memory unit 1, a display controller 2, and a voltage driving unit 3. The memory unit 1 receives and stores a gray-level matrix signal 5. The display controller 2 reads the gray-level matrix signal 5 from the memory unit 1 and generates a voltage-difference matrix signal, which controls the voltage driving unit 3 to provide a frame refreshing signal to drive an electrophoretic display 4. However, the movement of the charged pigment particles needs a given interval of time to complete. Further, even though a portion of pixels remain unchanged, a frame must be completely refreshed before the next frame begins to be refreshed. Thus, the refreshing frame rate may be decreased in facing continuous inputting of the gray-level matrix signals 5. For example, suppose it takes a refreshing time of 100 ms to alter the color of all the pixels of the electrophoretic display 4 from full white to full black (or from full black to full white); then, the refreshing time becomes 300 ms to complete inputting three separated gray-level matrix signals 5. When the electrophoretic display is used in a touchscreen, the problem of low frame rate is particularly obvious. For example, it is possible for a Chinese character having many strokes that the screen may have not yet presented the last several strokes when a user has written the complete Chinese character. Therefore, the conventional driver circuit needs improving to enhance the frame rate of the electrophoretic display.

SUMMARY OF THE INVENTION

In the conventional electrophoretic display, a frame for one gray-level matrix signal must be completely refreshed before the next frame for another gray-level matrix signal begins to be refreshed, wherefore the frame refreshing rate may be decreased in facing continuous inputting of the gray-level matrix signals, and wherefore the motion pictures may become sluggish. One objective of the present invention is to provide a driver circuit to improve the problem of motion picture lag.

The present invention proposes a multiplex electrophoretic display driver circuit, which comprises a memory unit, a display controller and a voltage driving unit. The memory unit has two registers respectively storing a current gray-level matrix signal and a former gray-level matrix signal. Each of the gray-level matrix signals contains gray-level data corresponding to a plurality of electrophoretic pixels of an electrophoretic display. The display controller includes an encoding circuit and a counting circuit. According to a difference between the current gray-level matrix signal and the former gray-level matrix signal, the encoding circuit generates a difference-value matrix signal containing a plurality of difference values and then generates a voltage-difference matrix signal containing a plurality of voltage-difference signals corresponding to the electrophoretic pixels. The counting circuit receives the difference-value matrix signal and counts to generate a plurality of refreshing values corresponding to the difference values. The encoding circuit adds the refreshing values to a next-cycled difference-value matrix signal to generate a new voltage-difference matrix signal. According to the voltage-difference matrix signal, the voltage driving unit applies a plurality of voltage differences to drive the electrophoretic pixels of the electrophoretic display.

The voltage-difference matrix signal is generated via adding the refreshing values to the difference-value matrix signal. The counting circuit utilizes a plurality of counters to perform step counting respectively and generate the refreshing values. Therefore, the difference-value matrix signal and the refreshing values added to the difference-value matrix signal can drive the electrophoretic display to refresh frame by processing multiple gray-level matrix signals simultaneously, whereby the efficiency of frame refreshing rate is promoted.

DETAILED DESCRIPTION OF THE PREFERRED EMBODIMENTS

Figure 1:
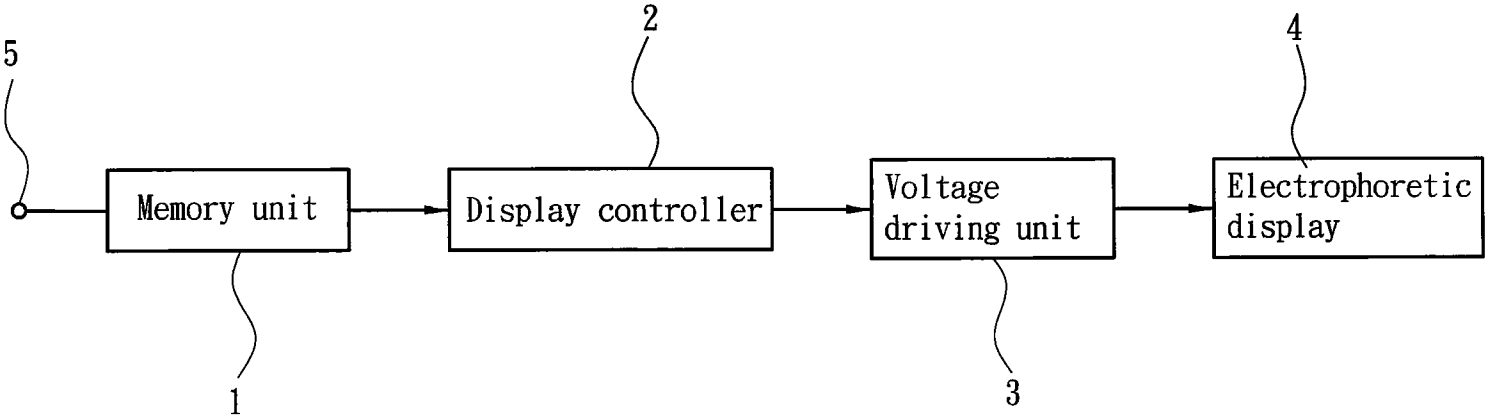
Fig. 1 PRIOR ART
FIG. 1 is a block diagram schematically showing a conventional driver circuit of an electrophoretic display.
Figure 2:
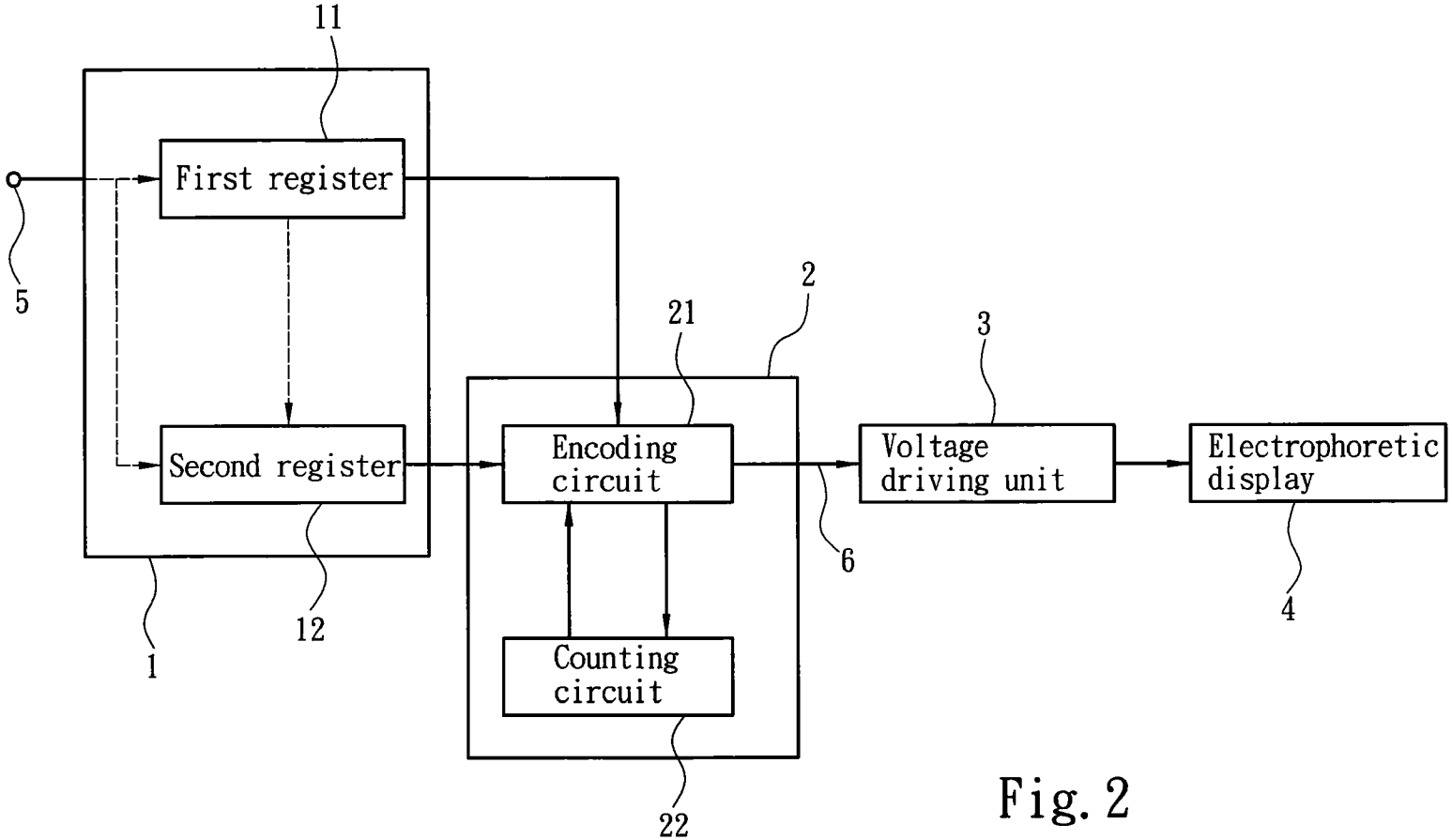
FIG. 2 is a block diagram schematically showing a multiplex electrophoretic display driver circuit according to the present invention.

Refer to FIG. 2. The present invention proposes a multiplex electrophoretic display driver circuit, which comprises a memory unit 1, a display controller 2 and a voltage driving unit 3. The multiplex electrophoretic display driver circuit generates a voltage-difference matrix signal 6 according to a gray-level matrix signal 5. The voltage driving unit 3 utilizes the voltage-difference matrix signal 6 to drive an electrophoretic display 4 having a plurality of electrophoretic pixels 41 (shown in FIGS. 3A-3E). The gray-level matrix signal 5 contains a plurality of gray-level data corresponding to the electrophoretic pixels 41. The voltage-difference matrix signal 6 contains a plurality of voltage-difference data corresponding to the electrophoretic pixels 41. Each of the gray-level data instructs the corresponding electrophoretic pixel 41 to present a gray level between black and white. Each of the voltage-difference data indicates a voltage difference applied to the corresponding electrophoretic pixel 41 to realize the gray level required by the corresponding gray-level data. Suppose the electrophoretic display 4 supports four gray levels. If one of the gray-level data requires the corresponding electrophoretic pixel 41 to change from full white (denoted by G3) to full black (denoted by G0), the corresponding electrophoretic pixel 41 needs to perform color changes three times (from G3 to G0). In such a case, the application of the voltage difference spans three frame times. Each of the voltage-difference data enables the voltage driving unit 3 to apply a positive voltage difference to the corresponding electrophoretic pixel 41. The memory unit 1 includes two registers respectively defined to be a first register 11 and a second register 12. The display controller 2 includes an encoding circuit 21 and a counting circuit 22. The first and second registers 11 and 12 store the current and former gray-level matrix signals 5. The present invention doses not limit the storing mode of the first and second registers 11 and 12. The first and second registers 11 and 12 may simultaneously connect to a source of the gray-level matrix signal 5 and alternately receive the current gray-level matrix signal 5 and preserve the former gray-level matrix signal 5. Alternatively, one specified register is fixedly used to receive the current gray-level matrix signal 5. In such a case, the specified register will not receive the current gray-level matrix signals until the specified register has transferred the former gray-level matrix signal 5 to the other register. As long as the two registers can perform the storage of the current and former gray-level matrix signals 5, the present invention does not limit the storing mode of the two registers. The encoding circuit 21 receives the current and former gray-level matrix signals 5 and generates a difference-value matrix signal containing a plurality of difference values according to the difference between the current and former gray-level matrix signals 5. The difference values are obtained from the difference of the corresponding gray-level data respectively in the current and former gray-level matrix signals 5. For example, the gray-level data in the third column and the fourth row of two gray-level matrices are respectively G3 and G1 and have a difference of 2, whereby a single difference value is obtained from the corresponding gray-level data in the current and former gray-level matrix signals 5. The encoding circuit 21 can obtain the difference-value matrix signal from the current and former gray-level matrix signals 5. The counting circuit 22 receives the difference-value matrix signal and counts to generate a plurality of refreshing values corresponding to the difference values. The counting circuit 22 has a counter matrix corresponding to the difference-value matrix signal, and the counter matrix contains a plurality of counters corresponding to the difference values. Each of the counters corresponding to one of the difference values calculates the corresponding difference value to generate a refreshing value via counting (such as step counting, e.g. step addition or step subtraction). Thus, the counter matrix can generates the refreshing values corresponding to the difference values. The time interval of the counters take to perform step counting is equal to the time interval of the encoding circuit 21 takes to obtain the gray-level matrix signal 5. Therefore, the counting circuit 22 can provides the refreshing values at the same time when the encoding circuit 21 obtains a next-cycled difference-value matrix signal. The encoding circuit 21 adds the refreshing values to the next-cycled difference-value matrix signal to generate a new voltage-difference matrix signal 6 for driving the electrophoretic display 4. Besides, the counters set an initial value to assist in the step counting. After obtaining the difference value, each of the counters performs step counting to reach the initial value and determines the time interval of applying the voltage-difference signal.

Below is stated the efficacy the abovementioned circuit architecture achieves. Initially, after obtaining the gray-level matrix signal 5, the encoding circuit 21 generates the difference-value matrix according to the present condition of the display; in other words, the encoding circuit 21 determines which electrophoretic pixel 41 needs change and the extent of the change. Then, the counting circuit 22 obtains the gray-level matrix signal 5. At the same time, the display controller 2 determines voltage and polarity respectively used to drive the specific electrophoretic pixel 41 according to the difference-value matrix, and then the display controller 2 outputs the voltage-difference matrix signal 6 to the voltage driving unit 3 for driving the electrophoretic display 4. Meanwhile, the counting circuit 22 performs step counting to obtain the refreshing values corresponding to the difference-value matrix. The counting circuit 22 obtains the refreshing values via performing step counting (step addition or step subtraction) to make the difference values reach the initial value, whereby the voltage-difference signal can be applied to the electrophoretic pixels 41 for sufficient time interval to ensure the correctness of colors. When the current gray-level matrix signal 5 is written into one of the first and second registers 11 and 12, the former gray-level matrix signal 5 is stored into the other register. The encoding circuit 21 compares the current and former gray-level matrix signals 5 to generate the difference-value matrix, whereby can be determined which electrophoretic pixel 41 will be driven to alter color by the new gray-level matrix signal 5. The encoding circuit 21 adds the refreshing values, which are output by the counting circuit 22, to the next-cycled difference-value matrix to obtain the new voltage-difference matrix signal 6. Then, the voltage driving unit 3 receives the new voltage-difference matrix signal 6 to drive the electrophoretic display 4. The refreshing values vary with the new difference-value matrix received by the encoding circuit 21. Thereby, when the display controller 2 receives the gray-level matrix signal 5, the encoding circuit 21 generates the difference-value matrix to drive the corresponding electrophoretic pixels 41 to change color, and the counting circuit 22 performs step counting until one of the difference values reaches the initial value to ensure that the corresponding electrophoretic pixels 41 have sufficient time interval to complete the change. The other gray-level matrix signal 5 also drives the corresponding electrophoretic pixels 41 to change color, and the counters of the counting circuit 22 respectively performs step counting of the difference values independently, whereby the two different gray-level matrix signals simultaneously drive different electrophoretic pixels 41 to change color without mutual interference. Thus is achieved a multiplex process. The electrophoretic display 4 may be a touch-control type electrophoretic display, and the touch control circuit thereinside is triggered by user's pressing to generate the gray-level matrix signal 5. The touchscreen includes the capacitive type, the resistive type, the infrared type, etc. The technology of the touchscreen is not the focus of the present invention but has been the prior art presented in many documents. Therefore, it will not repeat herein.

Refer to FIGS. 3A-3E diagrams schematically showing an electrophoretic display 4 driven by a multiplex electrophoretic display driver circuit according to the present invention. Suppose that the electrophoretic display 4 supports four gray levels and that it takes the electrophoretic pixel three frame times to drive a gray-level varying from full white to full black. Suppose the encoding circuit 21 obtains a gray-level matrix 5 and generates the difference-value matrix shown in Table.1.

TABLE 1

| Difference-value matrix (1) | | | | | | | | |
|---|---|---|---|---|---|---|---|---|
| 3 | 3 | 3 | 0 | 0 | ... | 0 | 0 | 0 |
| 3 | 3 | 3 | 0 | 0 | ... | 0 | 0 | 0 |
| 3 | 3 | 3 | 0 | 0 | ... | 0 | 0 | 0 |
| . | . | . | . | . | . | . | . | . |
| . | . | . | . | . | . | . | . | . |
| . | . | . | . | . | . | . | . | . |
| 3 | 3 | 3 | 0 | 0 | ... | 0 | 0 | 0 |
| 3 | 3 | 3 | 0 | 0 | | 0 | 0 | 0 |

Figure 3A:
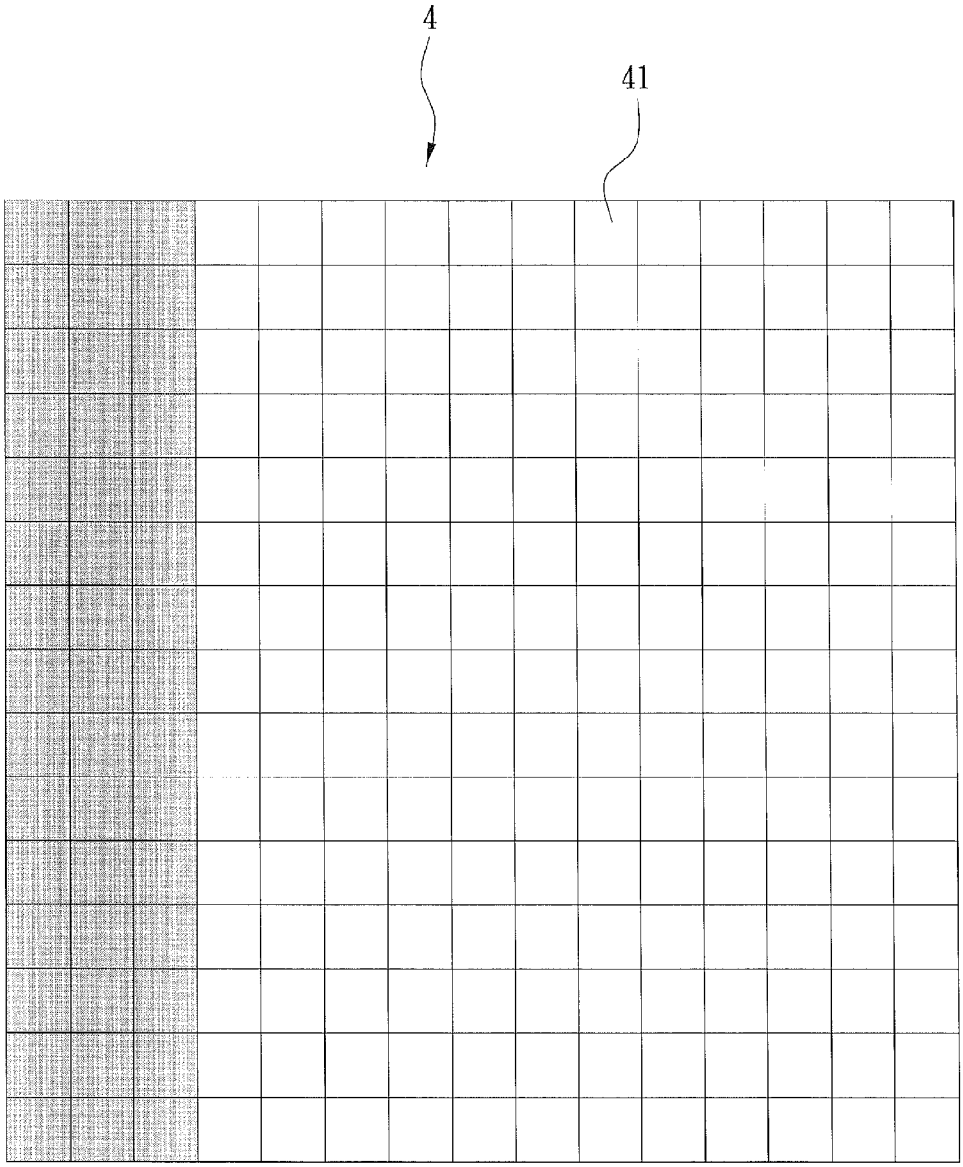
FIGS. 3A-3E are diagrams schematically showing an electrophoretic display driven by a multiplex electrophoretic display driver circuit according to the present invention.
Figure 3B:
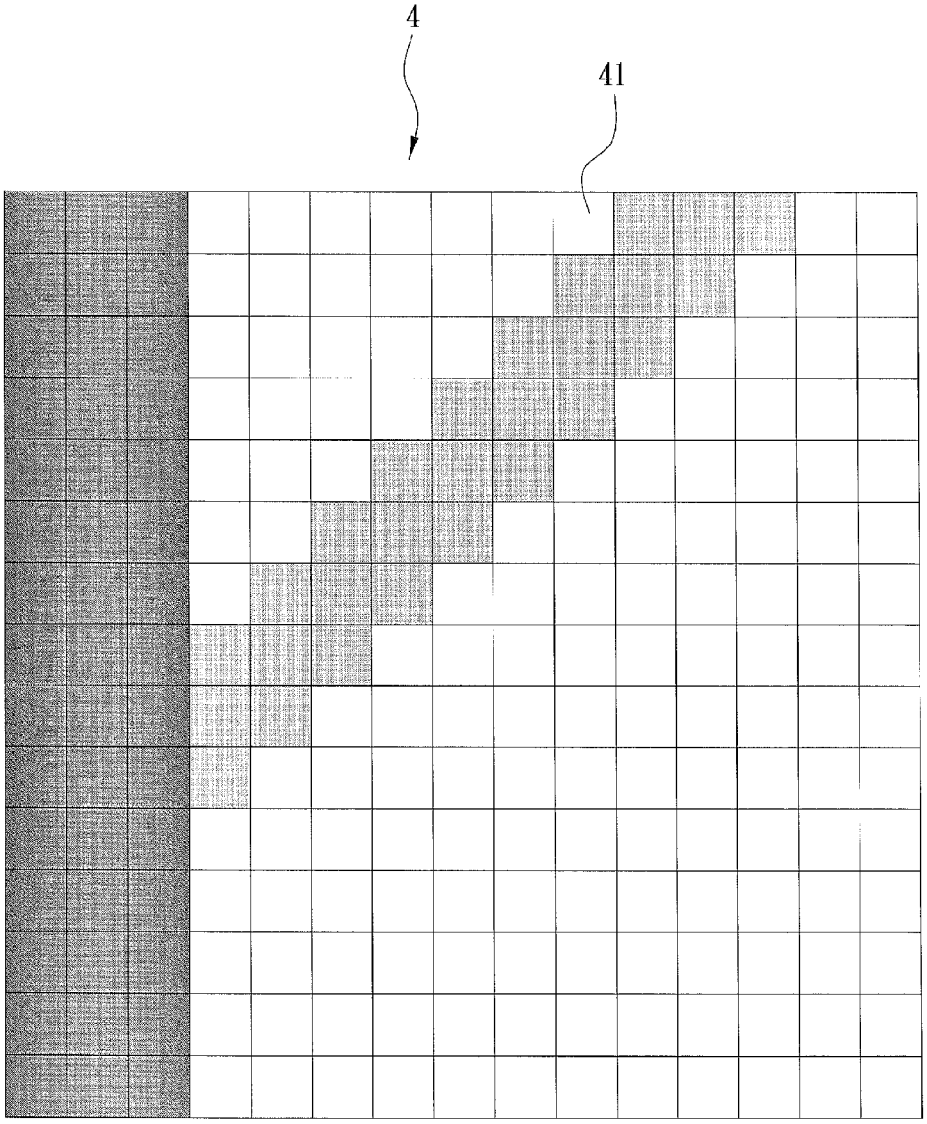
Figure 3C:
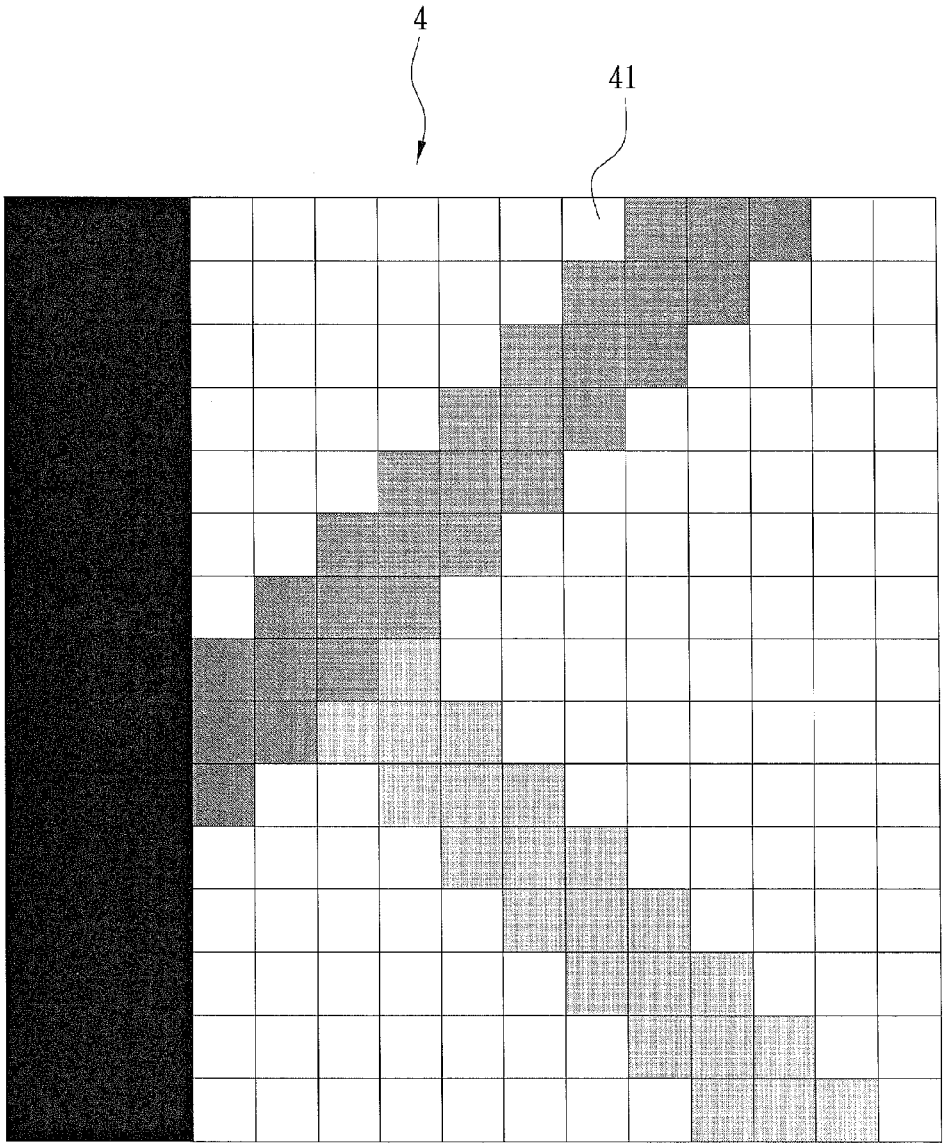

The numbers inside the difference-value matrix denote the required number of the gray-level changes of the corresponding electrophoretic pixels 41. "0" is the initial value of the counters. The electrophoretic pixels 41 corresponding to the left three columns in Table.1 will perform three cycles of gray-level changes. As shown in FIG. 3A, in the first cycle, the display controller 2 begins to drive the electrophoretic pixels 41 to change gray levels according to the difference-value matrix in Table.1. Suppose that there is a second gray-level matrix signal 5 inputted and that the refreshing values generated by the counting circuit 22 are added to the second gray-level matrix signal 5 to generate the difference-value matrix shown in Table.2.

TABLE 2

| Difference-value matrix (2) | | | | | | | | | | |
|---|---|---|---|---|---|---|---|---|---|---|
| 2 | 2 | 2 | 0 | 0 | ... | 3 | 3 | 3 | 0 | 0 |
| 2 | 2 | 2 | 0 | 0 | ... | 3 | 3 | 0 | 0 | 0 |
| 2 | 2 | 2 | 0 | 0 | ... | 3 | 0 | 0 | 0 | 0 |
| . | . | . | . | . | . | . | . | . | . | . |
| . | . | . | . | . | . | . | . | . | . | . |
| . | . | . | . | . | . | . | . | . | . | . |
| 2 | 2 | 2 | 0 | 0 | ... | 0 | 0 | 0 | 0 | 0 |
| 2 | 2 | 2 | 0 | 0 | | 0 | 0 | 0 | 0 | 0 |

By performing step counting, the difference values generated in the former cycle gradually return to the initial value. Meanwhile, the second gray-level matrix signal 5 has been inputted and varies part of the difference values in the difference-value matrix. As each of the counters of the counting circuit 22 operates independently, they do not interfere with each other. In the second cycle, the display controller 2 controls the voltage driving unit 3 to drive the electrophoretic display 4 to present the pattern shown in FIG. 3B. It can be seen in FIG. 3B that the electrophoretic pixels 41, which were driven to change gray levels in the first cycle, have presented a darker color. In the second cycle, another part of electrophoretic pixels 41 just begin to change the gray levels and only present a lighter color. In the third cycle, there is a third gray-level matrix signal 5 inputted, and the difference-value matrix is shown in Table.3.

TABLE 3

| Difference-value matrix (3) | | | | | | | | | | |
|---|---|---|---|---|---|---|---|---|---|---|
| 1 | 1 | 1 | 0 | 0 | ... | 2 | 2 | 2 | 0 | 0 |
| 1 | 1 | 1 | 0 | 0 | ... | 2 | 2 | 0 | 0 | 0 |
| 1 | 1 | 1 | 0 | 0 | ... | 2 | 0 | 0 | 0 | 0 |
| . | . | . | . | . | . | . | . | . | . | . |
| . | . | . | . | . | . | . | . | . | . | . |

TABLE 3-continued

| Difference-value matrix (3) | | | | | | | | | | |
|---|---|---|---|---|---|---|---|---|---|---|
| . | . | . | . | . | . | . | . | . | . | . |
| 1 | 1 | 1 | 0 | 0 | ... | 3 | 3 | 3 | 0 | 0 |
| 1 | 1 | 1 | 0 | 0 | | 0 | 3 | 3 | 3 | 0 |

It can be seen in Table.3 that the third set of difference values is added to the difference-value matrix. By continuously performing step counting, the difference values added in the former two cycles gradually return to the initial value. The display controller 2 continues to control the voltage driving unit 3 to drive the electrophoretic display 4 according to the difference-value matrix. In the third cycle, the electrophoretic pixels 41 corresponding to the first gray-level matrix signal 5 have completed the process to change gray levels from full white to full black. In the third cycle, the electrophoretic pixels 41 corresponding to the second and third gray-level matrix signals 5 are still changing gray levels.

The difference-value matrix after the third cycle is shown in Table.4.

TABLE 4

| Difference-value matrix (4) | | | | | | | | | | |
|---|---|---|---|---|---|---|---|---|---|---|
| 0 | 0 | 0 | 0 | 0 | ... | 1 | 1 | 1 | 0 | 0 |
| 0 | 0 | 0 | 0 | 0 | ... | 1 | 1 | 0 | 0 | 0 |
| 0 | 0 | 0 | 0 | 0 | ... | 1 | 0 | 0 | 0 | 0 |
| . | . | . | . | . | . | . | . | . | . | . |
| . | . | . | . | . | . | . | . | . | . | . |
| . | . | . | . | . | . | . | . | . | . | . |
| 0 | 0 | 0 | 0 | 0 | ... | 2 | 2 | 2 | 0 | 0 |
| 0 | 0 | 0 | 0 | 0 | | 0 | 2 | 2 | 2 | 0 |

Figure 3D:
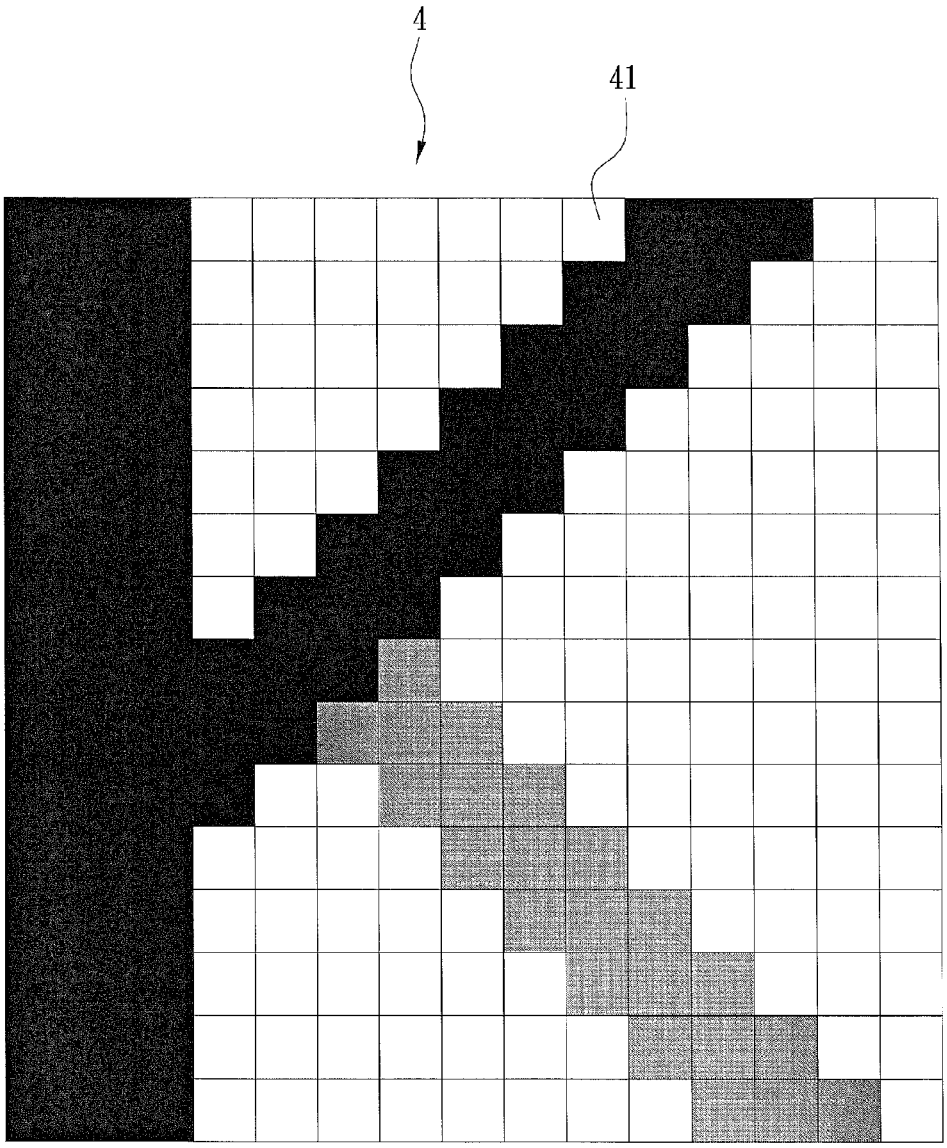
Figure 3E:
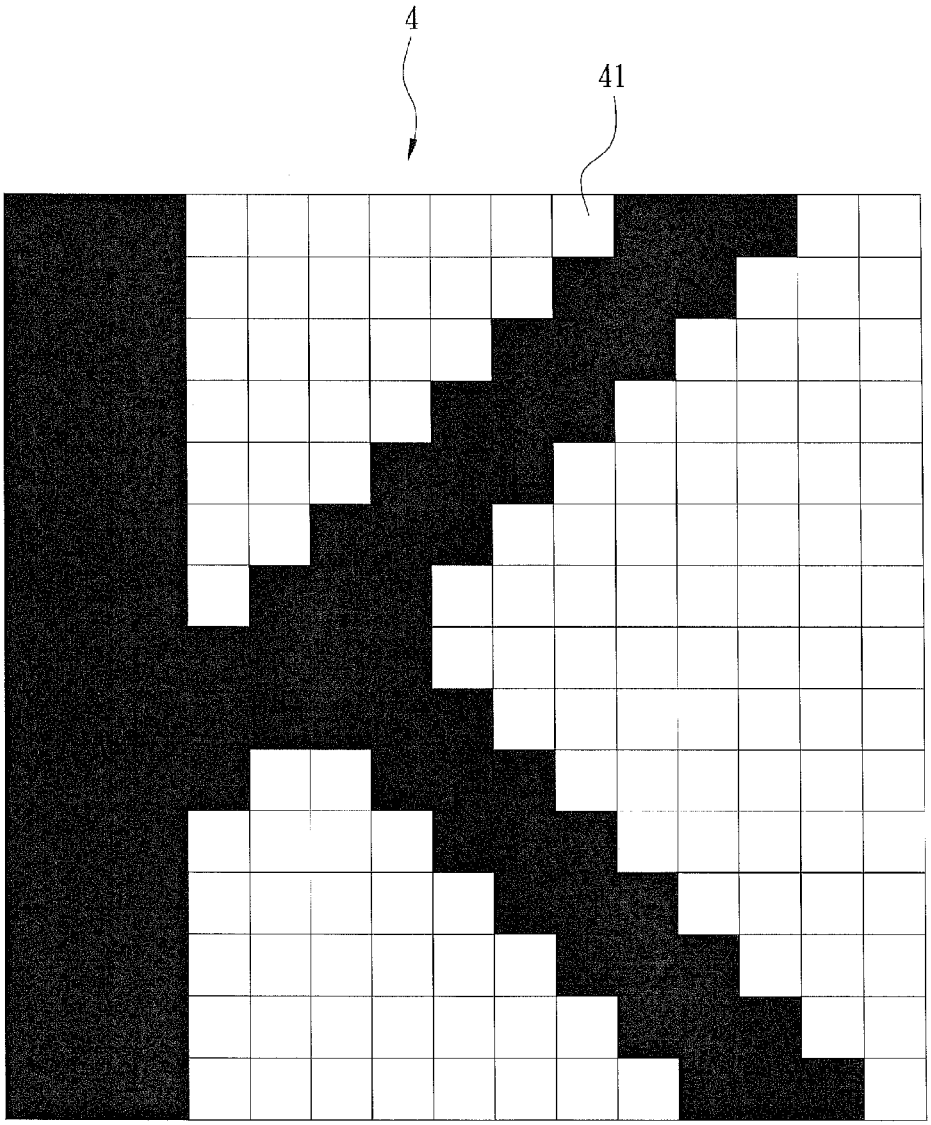

It can be seen in Table.4 that the step counting makes the difference values to reach the initial value. The time interval of the step counting take to reach the initial value determines the time interval for which the voltage-difference signal is applied to the corresponding electrophoretic pixel 41. Therefore, the difference value determines the time interval for applying the voltage-difference signal and the numbers of the gray-levels of the corresponding electrophoretic pixels 41 moves. The numbers, which have not yet returned to the initial value in the difference-value matrix of Table.4, continue to step count, and the electrophoretic display 4 continue to change gray levels, as shown in FIG. 3D and FIG. 3E.

In conclusion, the difference-value matrix and the refreshing values are combined to generate the voltage-difference matrix signal 6. The counting circuit 22 utilizes the counters to respectively perform step counting independently to generate the refreshing values. The refreshing values are added to the difference-value matrix to drive the electrophoretic display 4. Thereby, the electrophoretic display 4 can simultaneously perform the frame refreshings demanded by several gray-level matrix signals 5. Thus is achieved a multiplex process. Accordingly, the present invention can promote the frame refreshing efficiency and rate, especially the frame refreshing rate of a touch-control type electrophoretic display 4.

The embodiments described above are only to exemplify the present invention but not to limit the scope of the present invention. Any equivalent modification or variation according to the spirit of the present invention is to be also included within the scope of the present invention, which is based on the claims stated below.

What is claimed is:

1. A multiplex electrophoretic display driver circuit, comprising:

a memory unit adapted to receive gray-level matrix signals, the memory unit comprising two registers respectively storing a current gray-level matrix signal and a former gray-level matrix signal;

an encoding circuit adapted to generate a difference-value matrix signal according to a difference between the current gray-level matrix signal and the former gray-level matrix signal, and then output a voltage-difference matrix signal which corresponds to a plurality of electrophoretic pixels, wherein the difference-value matrix signal contains a plurality of difference values;

a counting circuit adapted to receive the difference-value matrix signal from the encoding circuit and including a plurality of counters which are corresponding to the plurality of difference values respectively and perform step counting to generate a plurality of refreshing values, wherein the encoding circuit adds the plurality of refreshing values to a next-cycled difference-value matrix signal to renew the voltage-difference matrix signal; and a voltage driving unit adapted to receive the voltage-difference matrix signal from the encoding circuit to drive the plurality of electrophoretic pixels of an electrophoretic display.

2. The multiplex electrophoretic display driver circuit according to claim 1, wherein the counters set an initial value and determine a time interval for applying the voltage-difference signals via step counting the difference values to reach the initial value.

3. The multiplex electrophoretic display driver circuit according to claim 2, wherein the time interval of the counters take to perform the step counting is equal to the time interval of the encoding circuit takes to obtain the gray-level matrix signal.

4. The multiplex electrophoretic display driver circuit according to claim 1, wherein the electrophoretic display is a touch-control type electrophoretic display controlled by pressing of users to generate the gray-level matrix signal.

* * * * *